United States Patent [19]

Domes

[11] Patent Number: 4,942,061

[45] Date of Patent: Jul. 17, 1990

[54] PROCESS FOR THE PRODUCTION OF ELECTRICALLY INSULATING COATINGS ON METALLIC SURFACES

[75] Inventor: Heribert Domes, Weilmünster, Fed. Rep. of Germany

[73] Assignee: Stahlwerke Bochum AG, Bochum, Fed. Rep. of Germany

[21] Appl. No.: 306,021

[22] PCT Filed: Jun. 11, 1988

[86] PCT No.: PCT/DE88/00351

§ 371 Date: Jan. 26, 1989

§ 102(e) Date: Jan. 26, 1989

[87] PCT Pub. No.: WO88/10288

PCT Pub. Date: Dec. 29, 1988

[30] Foreign Application Priority Data

Jun. 17, 1987 [DE] Fed. Rep. of Germany ..... 3720217

[51] Int. Cl.[5] ..... C23C 26/00

[52] U.S. Cl. ..... 427/104; 427/207.1; 427/247; 427/410; 427/388.4

[58] Field of Search ..... 427/104, 207.1, 247, 427/410, 388.4

[56] References Cited

U.S. PATENT DOCUMENTS

| | | | |
|---|---|---|---|
| 3,231,462 | 1/1966 | Oswald | 427/416 |
| 3,642,530 | 2/1972 | Webb | 427/410 |
| 4,268,578 | 5/1981 | Bordini | 427/416 |
| 4,366,185 | 12/1982 | Tanaka | 427/410 |
| 4,383,055 | 5/1983 | Johannes | 427/410 |
| 4,510,199 | 4/1985 | Brooken | 427/416 |
| 4,542,070 | 9/1985 | Ohtani | 427/410 |

*Primary Examiner*—Shrive Beck
*Assistant Examiner*—Vi Duong Dang
*Attorney, Agent, or Firm*—Felfe & Lynch

[57] ABSTRACT

An electrically insulating coating is formed on a metallic surface by applying a film of an aqueous fluoride-free composition which contains a water-dilutable synthetic resin, a dispersed waxlike substance, an inorganic or organic pigment, a borate, an alkali metal hydroxide, ammonia or an organic amine for adjusting the pH to between 7 and 9, and drying the moist film at a temperature between 120 and 350° C.

17 Claims, No Drawings

PROCESS FOR THE PRODUCTION OF ELECTRICALLY INSULATING COATINGS ON METALLIC SURFACES

DESCRIPTION

This invention relates to a process of forming electrically insulating coatings on metallic surfaces and the use of that process for the production of electrically insulating coatings on metallic surfaces of silicon-containing steel.

This invention relates to a process of applying an electrically insulating layer to sheet steel by means of a resin-containing aqueous treating liquor, which is dried when it has been applied.

In the manufacture of iron cores, e.g., for motors, transformers and the like, it is known to provide electric sheet steel with an insulating layer, subsequently to blank the sheet steel, to stack the blanks and optionally to join them by welding at their cut edges.

Such insulating layers may be inorganic or organic and may be formed, e.g., by means of treating liquors which contain chromic acid and/or phsophoric acid and/or phosphates. Whereas such layers usually have a satisfactory insulating resistance, the wear of the blanking tools will generally be relatively high in such cases and the use of chromic acid is not desirable from the aspect of work place, hygiene and from an ecological aspect.

Insulating layers of another kind are formed by an application of treating liquors which contain organic resins and optional inorganic additives and will result in a longer edge life of the tools in many cases but their bond strength after the stress-relieving annealing and their influence on the formation of the seam weld are unsatisfactory, as a rule. Insulating layers of a still further kind are formed by an application of treating liquors based on organic resins which contain fluorides of polyvalent metals, particularly aluminum fluoride and will not permit a satisfactory welding of the coated sheets if the thickness of the insulation exceeds a certain upper limit. Besides, the combustion of insulating layers consisting of combinations of organic resins and fluorides of polyvalent metals, e.g., during conventional welding operations, may result in a release of pollutants (EP-A-209,940).

It is an object of the invention to provide for the formation of electrically insulating coatings on metallic surfaces, particularly of silicon-containing steel, a process which minimizes at least some of the disadvantages of the abovementioned processes which are known in the art.

In order to accomplish that object the process which has been described first hereinbefore is carried out in such a manner in accordance with the invention that an aqueous preparation which contains (a) water-dilutable synthetic resin, (b) a dispersed waxlike substance having a particle size between 0.1 and 20 μm and a melting point between 80° and 250° C., (c) inorganic and/or organic pigment, (d) borate, (e) alkali metal hydroxide and/or ammonia and/or organic amine for adjusting a pH value between 7 to 9 and which is free of fluoride is applied to the metallic surface in a quantity between 0.5 and 20 g/m$^2$ (calculated as solids) and the moist film is subsequently dried at a (substrate) temperature between 120° and 350° for a time between 1 hour and 5 seconds.

In that context the term "drying" means primarily that the solvent contained in the preparation is evaporated but does not exclude the occurrence, e.g., of chemical reactions in or between the components of the preparation, such as cross-linking reactions, curing reactions and the like, and between said components and the metallic surface.

The process in accordance with the invention can be used to treat the surfaces of a very wide range of metals and has special significance for the formation of coatings on iron and ferrous alloys, particularly alloys which contain silicon as an alloying constituent, and of other substrates which are known as magnetic materials. Whereas the material to be insulated is usually provided as sheet metal in the form of strip or sheets, the process in accordance with the invention can also be applied to workpieces having other shapes.

An essential component of the aqueous preparation used in the process in accordance with the invention is a synthetic resin which can be diluted with water. Suitable resins are polyester, polyamide, epoxy, phenolic or melamine resins and/or latices based on acrylic acid, maleic acid esters, styrene, butadiene, ethylene acetate and/or vinyl acetate. The dilution with water will be promoted by the presence of neutralizable acid groups and/or by the presence of suitable emulsifiers. The use of an alkylphenol-modified polyester resin having an acid value between 90 and 110 and a molecular weight between 7000 and 15,000 has been found to be particularly desirable.

The dispersed waxlike substance may comprise polyethylene, polypropylene, polytetrafluoroethylene and/or polyamide. Coatings having particularly desirable properties will be obtained if micronized polyethylene wax is employed. The selected wax has preferably such a melting point that at least part of the wax is liquefied during the heating step. The wax component furnishes an important contribution to the good blanking qualities of sheet metal which has been coated by the process in accordance with the invention.

The inorganic and/or organic pigment serves to improve the electrical insulating properties and to improve the welding of blanked stacks of the sheet metal in a process in which one weld bead is applied to the cut edges which are disposed one over the other. For instance, the welding speed can sometimes be increased above 1500 mm/min without a formation of pores or pipes in the seam weld and without a formation of disturbing deposits of soot on both sides of the seam weld. Besides, the service life of the welding electrodes is considerably increased.

The pigments used in the process in accordance with the invention preferably comprise silicates, talcum, polymers consisting of vinyl groups or substituted vinyl groups and/or copolymers of vinylidene chloride or methyl methacrylate with acrylonitrile. The particle size is between 0.1 and 50 μm, preferably between 2 and 15 μm. A particularly desirable behaviour is exhibited by organic polymer pigments which expand to particle sizes between 2 and 40 μm during the heating.

The borate used in the preparation in accordance with the invention may be introduced as boric acid or its alkali metal salt, preferably in such a quantity that between 0.1 and 20 parts by weight borate, calculated as borax, are used per 100 parts by weight of synthetic resin. If the borate is used in the form of alkali metal borate, alkali metal hydroxide will usually not be required in the production of the preparation. The borate content has a desirable influence on the bond strength of the coating after an exposure to temperatures in the range from 500° to 850° C.

The organic amine which is employed preferably comprises one or more alkanolamines, such as dimethylaminoethanol and/or dimethylamine.

The components mentioned hereinbefore are preferably used in the preparation in accordance with the invention in the following quantities per 100 parts by weight of synthetic resin:

0.1 to 40 parts by weight dispersed waxlike substance
1 to 60 parts by weight inorganic and/or organic pigment
0.1 to 40 parts by weight borate, and
0.1 to 20 parts by weight organic amine.

In a further embodiment of the invention the aqueous preparation contains pyrogenic silica preferably in a quantity between 0.1 and 40 parts by weight per 100 parts by weight of synthetic resin. That component will improve the properties of the coating after preceding annealing processes and permits also an influence to be exerted on the rheological behaviour of the preparation and of the moist film.

The preparation preferably contains surfactants for optimizing the cross-linking and leveling properties of the preparation. The use of surfactant in a quantity between 0.1 and 10 parts by weight, preferably between 0.2 and 3 parts by weight, per 100 parts by weight of synthetic resin has been found to be suitable. Suitable ethine compounds, such as tertiary ethine glycol, are used to special advantage for that purpose because they provide a desirable combination of cross-linking, dispersing and foam-inhibiting activities.

It has also been found that it is desirable to add foam inhibitors to the preparations, e.g., in quantities between 0.1 and 10 parts by weight, preferably between 0.2 and 4 parts by weight, per 100 parts by weight of synthetic resin. Many treating liquors tend to incorporate emulsified air bubbles under the action of shearing forces. That tendency can be opposed by the co-use of foam inhibitors, which are preferably based on hydrocarbons, ethoxylated compounds and silicon-containing components.

The preparation in accordance with the invention is usually employed with a solids content between 10 and 80% by weight, balance water. It may be applied to the metallic surfaces by all methods which are known in painting technology, such as dipping, spraying, flooding, pouring, spreading and rolling. Sheet metal in the form of strip and sheet is preferably coated by means of rollers.

The heating of the moist film in order to dry and form the coating is also effected by the means known in painting technology.

In view of the high significance of the process in accordance with the process for the insulation of strip, that field of application will now be discussed more in detail.

The thickness of layer of moist film which consist of the treating liquor that has been applied to the strip and the thickness of the insulating layer which has been formed by the drying of said film will particularly depend on the solids content of the treating liquor, on the rate at which the treating liquor is conveyed by the rollers of the coater, particularly on the contact pressure between the several rollers, and also on the surface speed of the applicator roller relative to the speed of the steel strips.

In strip-coating processes the strip may be coated at a strip speed of, e.g., up to 120 m/min and more. The layer is subsequently dried at a (substrate) temperature between 120° and 350° C., preferably in a continuous oven for 1 hour to 5 seconds. The longer time will be used for low temperatures and the shorter time for higher temperatures. As an estimate, the residence time in the oven may amount to 20 seconds at 300° C.

By means of the abovementioned coating system the strips may be contacted with said treating liquor on one side or on both sides.

In dependence on the intended use, the insulated strip are used as wide strip or may be longitudinally slit by slitting apparatus before they are processed further. In the production of slit strips or narrow strips the particularly high bond strength and the elasticity of the insulating layer formed from the described treating liquor will be of advantage. A peeling off of the insulating layer would result in damage to the remaining insulated surface of the strip.

Another advantage is the particularly high resistance of the described insulating layer to corrosion during a storage in rooms having a particularly high humidity. The insulating layer provides an adequate protection against a corrosion of the sheet metal. Parts having various geometric configurations can be blanked from the insulated strip. In that operation the described insulating layer will reduce the friction of the blanking tools so that the wear of the tools will considerably be reduced and the intervals between the times at which the tools must be re-sharpened will be prolonged correspondingly.

During the blanking operation the high strength of the bond between the insulating layer and the sheet metal and the high flexibility will be a great advantage and will ensure that operation will not be disturbed by a peeling or dusting of the insulating layer or by a decrease of the insulating properties by such occurrences.

After the blanking operation the blanks are stacked and are often joined by welding at their edges. In that case it will be a special advantage that owing to the special composition of the insulating layer the welding can be performed at a speed in excess of 1500 mm/min without a formation of pores or pipes.

The process in accordance with the invention results, inter alia, in an excellent insulation of the metallic surfaces against a flow of electric currents,
in insulating sheets which can easily be blanked,
in a lower wear of the blanking tools,
in a strong adhesion of the coatings during and after mechanical stresses,
in excellent welding properties of the coated blanks which have been stacked,
in an excellent adhesion of the coatings after an exposure to a temperature between 500° and 850° C.,
in the absence of toxic components.

Owing to the special composition of the insulating layer a formation of soot, e.g., during a combustion of organic components of the insulation, will be prevented.

The special properties of the insulating layer ensure that the welding electrode will have a much longer service life than where the conventional organic insulations are provided. The service life of the electrode is the time for which the electrode can be operated before it must be re-pointed and re-adjusted.

A special advantage afforded by the invention resides in that the sheets have an excellent electric surface resistance even if the layer is very thin.

Because after a stress-relieving anneal the described insulation will form a firmly adhering layer consisting of oxide and/or combustion residue, a special advantage is afforded by the particularly high insulation resistance obtained after that operation.

The preferred processing in which the treating liquor is free of chromium compounds, particularly of chromate compounds, and of organic solvent, affords the additional advantage that a pollution will be avoided and that there is no need for special precautions to be taken during the treatment of the strip.

The invention will be explained by way of example and more in detail with reference to the drawings.

EXAMPLE 1

100 parts by weight of an alkylphenol-modified polyester resin (acid value about 100, molecular weight about 10,000) were mixed with 8 parts by weight of a micronized polyethylene wax, 12.0 parts by weight of a methyl methacrylate/acrylonitril copolymer consisting of spherical particles having an average diameter of 10 μm, 7 parts by weight of sodium borate (calculated as $Na_2B_4O_7.10H_2$), 8.0 parts by weight of an alkanolamine, 6.5 parts by weight of pyrogenic silica, 2.5 parts by weight of mixed surfactants consisting of ethine glycol, hydrocarbons, ethoxylated compounds and silicon-containing compounds, and 170 parts by weight of de-ionized water.

That preparation was applied by means of a rubber roller to the surfaces on both sides of a silicon-alloyed electric sheet steel having a nominal thickness of 0.5 mm (grade V 700-50 A in accordance with DIN 46400, Part 1). To dry the coating, the coated sheets were subsequently treated at a temperature of 300° C. for 20 seconds. The dry coating had an average thickness of 1 μm±0.1 μm.

The quality of the resulting insulating layer is apparent from the following Table.

EXAMPLE 2

The same treating liquor as in Example 1 was contacted with a silicon-alloyed electric sheet steel. The processing was carried out under the same conditions as in Example 1. The dry coating had an average thickness of 4 μm±0.5 μm.

The quality of the resulting insulating layer is apparent from the following Table.

EXAMPLE 3

45 parts by weight of the same alkylphenol-modified polyester resin as in Example 1 were mixed with 25 parts by weight of an acrylate resin, 30 parts by weight of a partly hydroxymethylated melamine resin, 8 parts by weight of a micronized polyethylene wax, 12.0 parts by weight of a methyl methacrylate/acrylonitrile copolymer consisting of spherical particles having an average diameter of 10 μm, 7.0 parts by weight of sodium borate (calculated as $Na_2B_4O_7.10H_2O$), 8.0 parts by weight of an alkanolamine, 6.5 parts by weight of pyrogenic silica. 2.5 parts by weight of mixed surfactants consisting of ethine glycol, hydrocarbons, ethoxylated compounds and silicon-containing components, and 170 parts by weight of de-ionized water.

Processing was performed under the same conditions as in Example 1.

The average thickness of the dry coating amounted to 1.0 μm±0.5 μm.

The quality of the resulting insulating layer is apparent from the following Table.

EXAMPLE 4

100 parts by weight of the same alkylphenol-modified polyester resin as in Example 1 were mixed with 8.0 parts by weight of a micronized polyethylene wax, 3.0 parts by weight of a methyl methacrylate/acrylonitrile copolymer consisting of spherical particles having an average diameter of 10 μm, 9.0 parts by weight of a layered silicate having an average particle diameter of 10 μm, 7.0 parts by weight of sodium borate (calculated as $Na_2B_4O_7.10H_2O$), 8.0 parts by weight of an alkanolamine, 6.5 parts by weight of pyrogenic silica, 2.5 parts by weight of mixed surfactants consisting of ethine glycol, hydrocarbons, ethoxylated compounds and silicon-containing components, and 170 parts by weight of de-ionized water.

The processing was also effected under the same conditions as in Example 1.

The dry layer had an average thickness of 1,0 μm±0.5 μm.

The quality of the resulting insulating layer is apparent from the following Table.

CONTROL EXAMPLE 1

100 parts by weight of the same alkylphenol-modified polyester resin as in Example 1 were mixed with 8 parts by weight of a micronized polyethylene wax, 12.0 parts by weight of a methyl methacrylate/acrylonitrile copolymer consisting of spherical particles having an average diameter of 12 μm, 20 parts by weight of aluminum fluoride (calculated as $AlF_3.3H_2O$), 7 parts by weight of sodium borate (calculated as $Na_2B_4O_7.10H_2O$), 14 parts by weight of dimethylethanolamine and 115 parts by weight of de-ionized water.

The processing was performed under the same conditions as in Example 1.

The dry layer had an average thickness of 1.0 μm±0.5 μm.

The quality of the resulting insulating layer is apparent from the following Table.

CONTROL EXAMPLE 2

100 parts by weight of the same alkylphenol-modified polyester resin as in Example 1 were mixed with 8.0 parts by weight of a micronized polyethylene wax, 7.0 parts by weight of sodium borate (calculated as $Na_2B_4O_7.10H_2O$), 8.0 parts by weight of an alkanolamine, 2.5 parts by weight of mixed surfactants consisting of ethine glycol, hydrocarbons, ethoxylated compounds and silicon-containing components, and 170 parts by weight of de-ionized water.

The processing was also performed under the same conditions as in Example 1.

The dry layer had an average thickness of 1.0 μm±0.5 μm.

CONTROL EXAMPLE 3

100 parts by weight of the same alkyl-modified polyester resin as in Example 1 were mixed with 8.0 parts by weight of a micronized polyethylene wax, 20 parts by weight aluminum fluoride (calculated as $AlF_3.3H_2O$), 7.0 parts by weight of sodium borate (calculated as $Na_2B_4O_7.10H_2O$), 15 parts by weight of an alkanolamine, 2.5 parts by weight of mixed surfactants consisting of ethine glycol, hydrocarbons, ethoxylated compounds and silicon-containing components, and 170 parts by weight of de-ionized water.

The processing was effected under the same conditions as in Example 1.

The dry layer had an average thickness of 1.0 $\mu m \pm 0.5$ $\mu m$.

The quality of the resulting insulating layer is apparent from the following Table.

Explanation of the Table

The following Table contains the results obtained in the several Examples.

In line 2, the stability of the treating liquor after a storage for more than 4 weeks under standard conditions is stated. The homogeneity of the treating liquor was evaluated by visual inspection. The viscosity was determined in accordance with DIN 53211, 4 mm B, immediately after the preparation. After the treating liquor had been stored for more than four weeks the viscosity was measured again and was compared with the initially measured value.

In line 3, the thickness of the dry insulating layers formed from the treating liquors is stated for which the test results were determined. The values stated are averages of 20 to 50 individual measurements.

In line 4, the interlaminar contact resistance between the two insulating layers and the electric sheet before the annealing measured under a contact pressure of 100 $N/cm^2$, is stated in ohm-$cm^2$ for an electrode surface area of 4 $cm^2$ and at a voltage of 100 mV. A rating of R 50 means that 50% of the measured values exceed the stated resistance.

In line 5, the contact resistance measured under same conditions as in line 4 is stated as a result of measurements taken when the insulating layer had been annealed at 600° C. in air for one hour.

The bond strength, which reflects also the ductility of the layer, is stated in line 6 as a result of bending tests about a conical mandrel.

In line 7 the area is stated in which the surface of the sheet steel is still covered by firmly adherent insulation after an annealing at 600° C. in air for one hour. The adhesion was tested in that an adhesive tape was applied and subsequently torn off.

In line 8 the protection afforded by the insulating layer against a corrosion of the sheet steel is stated. The determination was effected by the test under changed air conditions in accordance with DIN 50017, in which the coated sheet is exposed to an atmosphere at 40% and a relative humidity of 100% for eight hours and is subsequently exposed to a standard room conditions for 16 hours.

The bond strength ratings for the cross-cut insulating layer are stated in line 9. To determine said ratings, the insulating layer was cross-cut as far as to the metallic surface into fields of 1 square millimeter each. An adhesive tape was applied and subsequently torn off. The fields which had been damaged or detached were determined. That test was carried out in accordance with DIN 53151.

To determine the solvent resistance stated in line 10, a defined portion of the insulating layer was wiped 50 times with a cotton swab that had been impregnated with methylane chloride ($CH_2Cl_2$) and any change was evaluated.

In line 11, the highest permissible velocity is stated at which a satisfactory, porefree seam weld can be formed under an argon atmosphere and at a current value of 90 to 120 amperes on a sheet metal stack under an applied pressure of 250 $N/cm^2$.

In line 12, the quantity of soot is stated which may form during a combustion of organic substances and is deposited along the edges of a seam weld.

Line 13 states the stability of the welding electrode used to weld the insulated and stacked blanks. The data stated reflect also the seam weld length which can be obtained without a need for a regrinding and/or readjustment of the electrode.

As is apparent from the Table the results regarding the contact resistance before and after the annealing (lines 4 and 5), the bond strength before and after the annealing (lines 6 and 7), the bond strength rating of the cross-cut layer (line 9), and the resistance to organic solvents (line 10) are consistently good. When compared with the Control Examples 1 and 3 the results of Examples 1 to 4 indicate an excellent stability of the treating liquors as regards homogeneity and viscosity (line 2) and protection against corrosion (line 8).

In accordance with line 11, porefree seam welds can be formed in Examples 1, 3 and 4 at an excellent welding speed. It is apparent from Example 2 that a porefree seam weld can be formed at a high welding speed even when the insulating layer has a thickness of 4 $\mu m \pm 0.5$ $\mu m$, as compared with the Control Examples 2 and 3. In Control Example 1 the highest permissible welding speed is higher than in Example 2 but can be achieved only when the insulating layers have a very small thickness of 1 $\mu m \pm 0.5$ $\mu m$. In Control Example 1 the stability of the treating liquor and the protection against corrosion are also inferior to Examples 1 and 4.

The quantity of soot which is formed (line 12) is much larger in Control Examples 2 and 3 than in Examples 1 to 4. Besides, the stability of the electrode is much lower in Control Examples 2 and 3 than in Examples 1 to 4. Regarding weldability, it is apparent from the Table that the invention affords a special advantage particularly over the Control Examples 2 and 3.

The results obtained in Examples 1 to 4 indicate that in comparison with Control Examples 1 to 3 the invention results in a combination of all good properties which are desired for electrically insulating layers on sheet steel for making magnetic cores.

TABLE

| 1. Properties | Example 1 | Example 2 | Example 3 |
|---|---|---|---|
| 2. Stability of treating liquor | very good | very good | very good |
| 3. Thickness of dry layer | 1 $\mu m \pm 0.5$ | 4 $\mu m \pm 0.5$ | 1 $\mu m \pm 0.5$ |
| 4. Contact resistance before annealing ohm-$cm^2$ | $R50 > 10^2$ | $R50 > 10^6$ | $R50 > 10^2$ |
| 5. Contact resistance after annealing | $R50 > 10^2$ | $R50 > 10^6$ | $R50 > 10^2$ |
| 6. Bond strength before annealing | <3 mm | <3 mm | <3 mm |

TABLE-continued

| | | | |
|---|---|---|---|
| 7. Adhering surface area after annealing | 100% | 100% | 100% |
| 8. Corrosion resistance evaluated in accordance with DIN 53210 | Ri O | Ri O | Ri O |
| 9. Cross-cut bond rating (DIN 53151) | GT O | GT O | GT O |
| 10. Resistance to organic solvents | no change | no change | no change |
| 11. Welding speed | >1500 mm/min | >1500 mm/min | >1500 mm/mi |
| 12. Formation of soot | very small | very small | very small |
| 13. Electrode stability | very good | good | very good |
| 1. Example 4 | Control Example 1 | Control Example 2 | Control Example 3 |
| 2. very good | poor | very good | poor |
| 3. 1 μm ± 0.5 | 1 μm ± 0.5 | 1 μm ± 0.5 | 1 μm ± 0.5 |
| 4. R50 > $10^2$ | R50 > $10^2$ | R50 > $10^2$ | R50 > $10^2$ |
| 5. R50 > $10^2$ | R50 > $10^2$ | R50 > $10^2$ | R50 > $10^2$ |
| 6. <3 mm | <3 mm | <3 mm | <3 mm |
| 7. 100% | 100% | 100% | 100% |
| 8. Ri O | Ri 4 | Ri O | Ri 4 |
| 9. GT O | GT O | GT O | GT O |
| 10. no change | no change | no change | no change |
| 11. >1500 mm/min | >1250 mm/min | >300 mm/min | >750 mm/min |
| 12. very small | very small | strong | strong |
| 13. very good | medium | poor | poor |

I claim:

1. The method of forming an electrically insulating coating on a metallic surface, which comprises applying a film of an aqueous composition which contains a. a water-dilutable synthetic resin, b. a dispersed waxlike substance having a particle size between 0.1 and 20 μm and a melting point between 80° and 250° C., c. for an inorganic or organic pigment, d. a borate, and e. an alkali metal hydroxide, ammonia or an organic amine for adjusting a pH value between 7 to 9, and which is free of fluoride to the metallic surface in a quantity between 0.5 and 20 g/m$^2$, and drying the moist film at a temperature between 120° and 350° for a time between 1 hour and 5 seconds.

2. The method of claim 1, wherein the aqueous composition which is applied to the metallic surface contains as the synthetic resin a polyester, polyamide, epoxy, phenolic or melamine resin or a latex based on acrylic acid, maleic acid esters, styrene, butadiene, ethylene acetate or vinyl acetate.

3. The method of claim 1, wherein the aqueous composition which is applied to the metallic surface contains as the synthetic resin an alkylphenol-modified polyester resin having an acid value between 90 and 110 and a molecular weight between 7000 and 15,000.

4. The method of claim 1, wherein the aqueous composition which is applied to the metallic surface contains as the dispersed waxlike substance polyethylene, polypropylene, polytetrafluoroethylene or polyamide.

5. The method of claim 1, wherein the aqueous composition which is applied to the metallic surface contains micronized polyethylene wax as the dispersed waxlike substance.

6. The method of claim 1, wherein the aqueous composition which is applied to the metallic surface contains a pigment comprising silicates, talcum, polymers consisting of vinyl groups or substituted vinyl groups or copolymers of vinylidene chloride or methyl methacrylate with acrylonitrile and having a particle size between 0.1 and 50 μm, preferably between 2 and 15 μm.

7. The method of claim 1, wherein the aqueous composition which is applied to the metallic surface contains a pigment comprising organic polymers which at an elevated temperature expand to particle sizes between 5 and 40 μm.

8. The method of claim 1, wherein the aqueous composition which is applied to the metallic surface contains an organic amine consisting of one or more alkanolamines, such as dimethylaminoethanol or dimethylamine.

9. The method of claim 1, wherein the aqueous composition which is applied to the metallic surface contains borax in a quantity between 0.1 and 20 parts by weight per 100 parts by weight of synthetic resin.

10. The method of claim 1, wherein the aqueous composition which is applied to the metallic surface contains the components in the following quantities per 100 parts by weight of synthetic resin:

0.1 to 40 parts by weight dispersed waxlike substance
1 to 60 parts by weight inorganic or organic pigment
0.1 to 40 parts by weight borate, and
0.1 to 20 parts by weight organic amine.

11. The method of claim 1, wherein the aqueous composition which is applied to the metallic surface contains pyrogenic silica in a quantity between 0.1 and 40 parts by weight per 100 parts by weight of synthetic resin.

12. The method of claim 1, wherein the aqueous composition which is applied to the metallic surface contains a surfactant.

13. The method of claim 12 in which the surfactant is an ethine compound.

14. The method of claim 13 in which the ethine compound is present in a quantity between 0.1 and 10 parts by weight per 100 parts by weight of synthetic resin.

15. The method of claim 1, wherein the aqueous composition which is applied to the metallic surface additionally contains a foam inhibitor.

16. The method of claim 15 in which the foam inhibitor consists of a mixture of hydrocarbons, ethoxylated compounds and silicon-containing compounds.

17. The method of claim 16 in which the foam inhibitor mixture is present in a quantity between 0.1 and 10 parts by weight per 100 parts by weight of synthetic resin.

* * * * *

UNITED STATES PATENT AND TRADEMARK OFFICE

CERTIFICATE OF CORRECTION

PATENT NO. : 4,942,061

DATED : July 17, 1990

INVENTOR(S) : Heribert Domes

It is certified that error appears in the above-identified patent and that said Letters Patent is hereby corrected as shown below:

Column 9, Control Example 2, Entry No. 11, " >300" should read -- <300--.

Column 9, line 33, delete "for".

Column 9, line 38, after "$m^2$", insert --calculated as solids,--.

Column 9, line 39, after "a" insert --substrate--.

Signed and Sealed this

Fifth Day of May, 1992

*Attest:*

*Attesting Officer*

DOUGLAS B. COMER

*Acting Commissioner of Patents and Trademarks*